US008177207B2

(12) United States Patent
Waters

(10) Patent No.: US 8,177,207 B2
(45) Date of Patent: May 15, 2012

(54) FIXTURE AND METHOD FOR SUPPORTING DOOR PANELS DURING PAINTING AND FINISHING

(76) Inventor: Earl Eugene Waters, Goldsboro, NC (US)

( * ) Notice: Subject to any disclaimer, the term of this patent is extended or adjusted under 35 U.S.C. 154(b) by 176 days.

(21) Appl. No.: 12/764,250

(22) Filed: Apr. 21, 2010

(65) Prior Publication Data

US 2011/0260384 A1 Oct. 27, 2011

(51) Int. Cl.
*B05B 13/02* (2006.01)
*B05C 13/00* (2006.01)

(52) U.S. Cl. ..... 269/55; 269/289 R; 269/136; 269/138; 269/53; 211/162; 118/500; 118/502; 29/281.1

(58) Field of Classification Search ..... 108/13, 108/143, 16, 3; 118/500, 502, 503; 160/134; 198/379; 211/1.53, 106.01, 110, 111, 116, 211/123, 124, 150, 162, 163, 165, 166, 168, 211/169, 41.15, 58, 94.01; 248/125.2, 127, 248/165, 166, 171, 201, 216.1, 217.3, 684; 269/104, 127, 17, 47, 54.1–54.5, 56, 57, 269/67, 71, 905; 294/61; *B05C 13/00, 13/02*
See application file for complete search history.

(56) References Cited

U.S. PATENT DOCUMENTS

| | | | | | |
|---|---|---|---|---|---|
| 121,801 | A | * | 12/1871 | Moritz | 118/502 |
| 482,171 | A | * | 9/1892 | Webster | 200/84 R |
| 482,771 | A | * | 9/1892 | Webster | 118/502 |
| 855,219 | A | * | 5/1907 | Anthony, Jr. | 118/502 |
| 1,053,613 | A | * | 2/1913 | Klingaman | 118/502 |
| 1,615,860 | A | * | 2/1927 | Williams | 269/76 |
| 2,557,231 | A | * | 6/1951 | Miller | 118/503 |
| 2,599,010 | A | * | 6/1952 | Pernitz | 269/55 |
| 2,921,688 | A | * | 1/1960 | Riemenschneider | 108/16 |
| 3,148,461 | A | * | 9/1964 | Johnson | 434/185 |
| 3,514,883 | A | * | 6/1970 | Albright | 40/492 |
| 4,155,609 | A | | 5/1979 | Skafte et al. | |
| 4,239,197 | A | * | 12/1980 | Olstad | 269/68 |
| 4,491,308 | A | * | 1/1985 | Walton et al. | 269/70 |

(Continued)

FOREIGN PATENT DOCUMENTS

DE 102008050435 B3 * 1/2010

(Continued)

OTHER PUBLICATIONS

Photographs, www.pivot-pro.com, Pivot Pro Online Home Page, Pivot Pro Page and Cabinet Pro Page, known on or about Apr. 21, 2010.

*Primary Examiner* — Joseph J Hail
*Assistant Examiner* — Tyrone V Hall, Jr.
(74) *Attorney, Agent, or Firm* — Womble Carlyle Sandridge & Rice, LLP

(57) ABSTRACT

A fixture that allows for quickly preparing, painting and finishing a plurality of door panels that have opposed side surfaces interconnected by a relatively narrow edge. The fixture includes upper and lower horizontal support bars. A plurality of spaced vertical support bars extend between and are slidably attached to the upper and lower horizontal support bars so that the spacing between vertical support bars may be adjusted to accommodate the size of the door panels. A plurality of mounting stations are on the vertical supports. A pair of pins are received by the mounting stations and engage the opposite edges of a panel for pivotal movement, painting and finishing of the panel there between.

12 Claims, 10 Drawing Sheets

U.S. PATENT DOCUMENTS

| | | | | | |
|---|---|---|---|---|---|
| 4,577,843 | A | * | 3/1986 | Milwain | 269/51 |
| 4,757,849 | A | | 7/1988 | Morris | |
| 5,070,796 | A | | 12/1991 | Marone et al. | |
| 5,085,397 | A | * | 2/1992 | Henkel | 248/688 |
| 5,090,648 | A | * | 2/1992 | Wood, IV | 248/125.3 |
| 5,164,011 | A | * | 11/1992 | Ray | 118/500 |
| 5,310,257 | A | | 5/1994 | Altieri, Jr. et al. | |
| 5,350,162 | A | * | 9/1994 | Cushing | 269/13 |
| 5,382,010 | A | | 1/1995 | Gerdes et al. | |
| 5,502,929 | A | * | 4/1996 | Daniels | 52/69 |
| 5,551,980 | A | | 9/1996 | Turnbo | |
| 5,733,061 | A | * | 3/1998 | Child | 403/385 |
| 5,879,021 | A | * | 3/1999 | Papendick | 280/638 |
| 5,894,945 | A | * | 4/1999 | Curran | 211/162 |
| 6,036,779 | A | | 3/2000 | Tolbert | |
| 6,050,559 | A | * | 4/2000 | de Souza | 269/208 |
| 6,090,204 | A | * | 7/2000 | Speed et al. | 118/500 |
| 6,322,061 | B1 | * | 11/2001 | Maser et al. | 269/17 |
| 6,338,758 | B1 | * | 1/2002 | Curran | 118/500 |
| 6,394,438 | B1 | * | 5/2002 | Glaser | 269/43 |
| 6,561,470 | B1 | * | 5/2003 | Gottfredson et al. | 248/201 |
| 6,641,668 | B1 | | 11/2003 | Edgerton | |
| 6,702,130 | B1 | * | 3/2004 | Carlilse | 211/204 |
| 6,875,277 | B1 | | 4/2005 | Edgerton | |
| 7,108,144 | B2 | | 9/2006 | Goodwin | |
| 7,134,560 | B2 | | 11/2006 | Goodwin | |
| 7,290,892 | B2 | * | 11/2007 | Shieh | 359/872 |
| 7,448,606 | B1 | * | 11/2008 | Johnson | 269/17 |
| 7,481,323 | B2 | | 1/2009 | Fisher | |
| 7,870,834 | B1 | * | 1/2011 | Cundiff | 118/500 |
| 8,047,494 | B2 | * | 11/2011 | Chang | 248/316.1 |
| 2007/0272147 | A1 | * | 11/2007 | Navarro | 118/500 |

FOREIGN PATENT DOCUMENTS

KR 2010120923 A * 11/2010

* cited by examiner

FIXTURE AND METHOD FOR SUPPORTING DOOR PANELS DURING PAINTING AND FINISHING

FIELD OF THE INVENTION

The present invention is directed to a fixture and method for painting and finishing door panels or drawer fronts, and, in particular to a fixture for holding a plurality of door panels for painting and finishing thereof, and a method for working on a plurality of door panels.

BACKGROUND

Painting door and drawer panels for cabinets and the like is a time intensive process. Most contractors who work in this field will lay the panels flat on saw benches, boxes, and other makeshift work pieces. One side then is treated and left to dry. The panels are then flipped over to treat the other side. This is repeated as many times as is necessary to adequately treat, prime, paint, or otherwise finish the door panels. Between actual working time and drying, this process might take five to seven working days or more to complete 20 to 30 doors.

An additional drawback for current door panel preparation is also the amount of floor space typically required to prepare, treat, and dry the door panels. For cabinets in a medium size kitchen, there might be 20 to 30 different panels to work on. Using the makeshift work pieces, where only one or two panels are used per sawhorse pair, for example, the amount of space required to complete the job in an orderly fashion would be quite large.

There have been attempts to decrease the time needed to paint or finish a set of door panels. Various configurations of fixtures have been developed to hold a panel in place while working. These designs, however, still require an unreasonable amount of steps to prepare, paint, and finish a door panel, while not providing much, if any, improvement in the time required to complete the job.

SUMMARY OF INVENTION

The inventor has addressed this need for improved efficiency and space utilization in door panel painting by developing a fixture that allows for simultaneously quickly preparing, painting and finishing a plurality of panels. The door panels are typically for various cabinets, and other smaller doors, and the like. The terms "panels" or "door panels" are used interchangeably herein, and both refer to a panel that may be for either a cabinet door, kitchen cabinet door or drawer fronts, or small closets and the like, that has opposed side surfaces interconnected by a relatively narrow edge.

The fixtures include upper and lower horizontal support bars. A plurality of spaced vertical support bars extend between and are slidably attached to the upper and lower horizontal support bars so that the spacing between vertical support bars may be adjusted to accommodate the width of the door panels.

Another aspect of the invention is the vertical support bars themselves, which are U-shaped channels. Each bar is provided with a plurality of panel mounting stations, which, according to one aspect, are vertically spaced pairs of slots in the legs of the U-shaped channels. Pairs of pins are used with the mounting stations to support the door panels. Each pin having one end so configured as to engage and hold the narrow edge of one of the panels and a shaft so configured as to be received and supported by one of the slots in the adjacent vertical support bar. Each pair of pins removably engage the opposite edges of a panel and support one of the panels in the fixture for pivotal movement, painting and finishing of the panel.

According to another aspect of the invention, each pin includes a retainer sleeve which steadies the panel during finishing or painting to prevent unintended tilting or pivoting of the panel.

Another aspect of the invention is a method of economically holding, finishing and painting a plurality of panels. A user arranges a plurality of panels on the fixture and begins either prepping or painting one side of the panels. The fixtures may comprise a frame that can receive a plurality of panels of the same or different size or shape in a way that each of the panels may be pivotally mounted on the fixture. The plurality of panels are then turned about a pivot while remaining on the fixture, so the other side may be either prepped, painted or finished as the one side is drying.

DETAILED DESCRIPTION OF THE INVENTION

Certain exemplary embodiments of the present invention are described below and illustrated in the accompanying figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art, and all such alternate embodiments, modifications, and improvements are within the scope of the present invention.

Figure 1A:
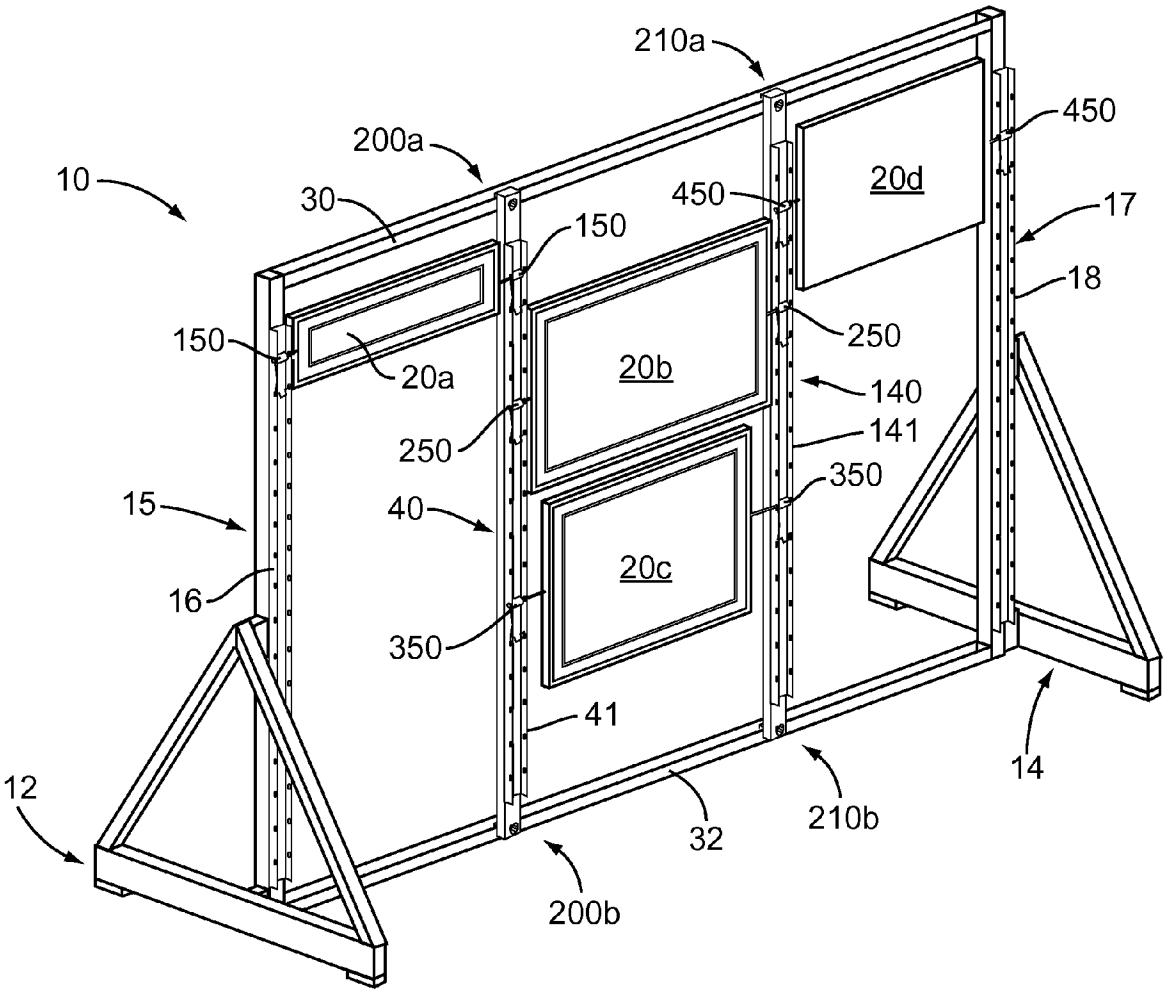
FIGS. 1A and 1B are top perspective views of a first embodiment of a fixture with and without a plurality of door panels arranged thereon, respectively.
Figure 1B:
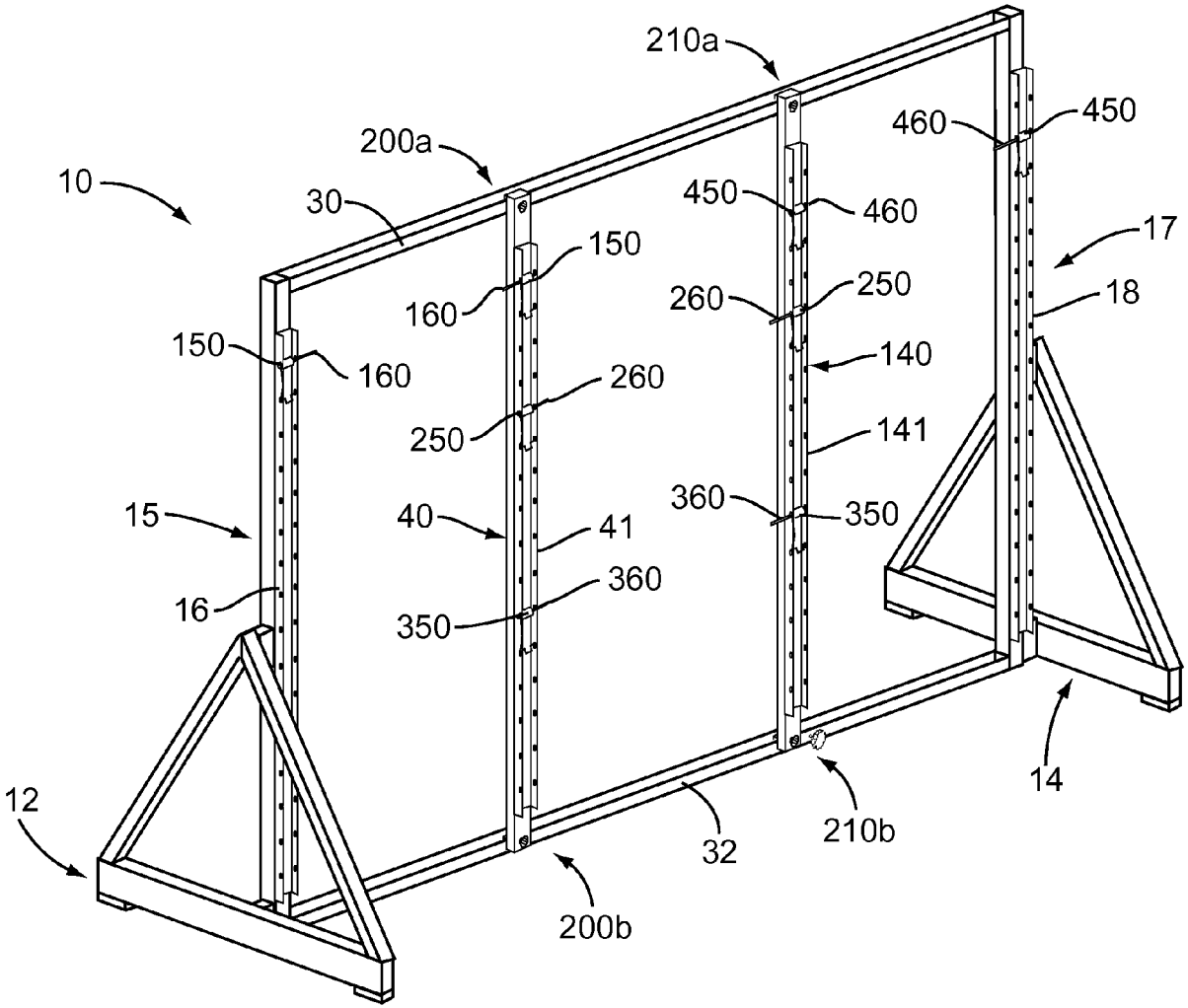

Referring to FIGS. 1A and 1B, a fixture 10 is shown holding a plurality of door panels 20*a*, 20*b*, 20*c*, and 20*d* for preparation, painting and finishing thereof. The fixture 10 includes side supports 15 and 17, upper and lower horizontal supports 30 and 32, and a plurality of vertical supports 40 and 140 attached to the horizontal supports 30 and 32. Vertical supports 40 and 140 are exemplary only in that there can be more. Frame struts 12 and 14 provide stability to and support fixture 10. The side supports 15, 17 and vertical 40, 140 supports include channels 16, 18, 41 and 141, respectively. The supports/channels have a plurality of mounting stations, as will be discussed below. The panels 20*a*, 20*b*, 20*c*, and 20*d* are held in position by, and are pivotable between, pairs of pins 160, 260, 360, and 460 on the mounting stations 150, 250, 350, 450, respectively. The number of mounting stations and pin pairs may be increased to provide for more variance in the vertical dimension (height) of the door or drawer panels as needed. The side supports 15, 17 and vertical supports 40 and 140 are illustrated as continuous, but could be discontinuous, depending on the gauge or strength of the channels 16, 18, 41, and 141. If strong enough, channels 16, 18, 41, and 141 could be used without supports.

Figure 1C:
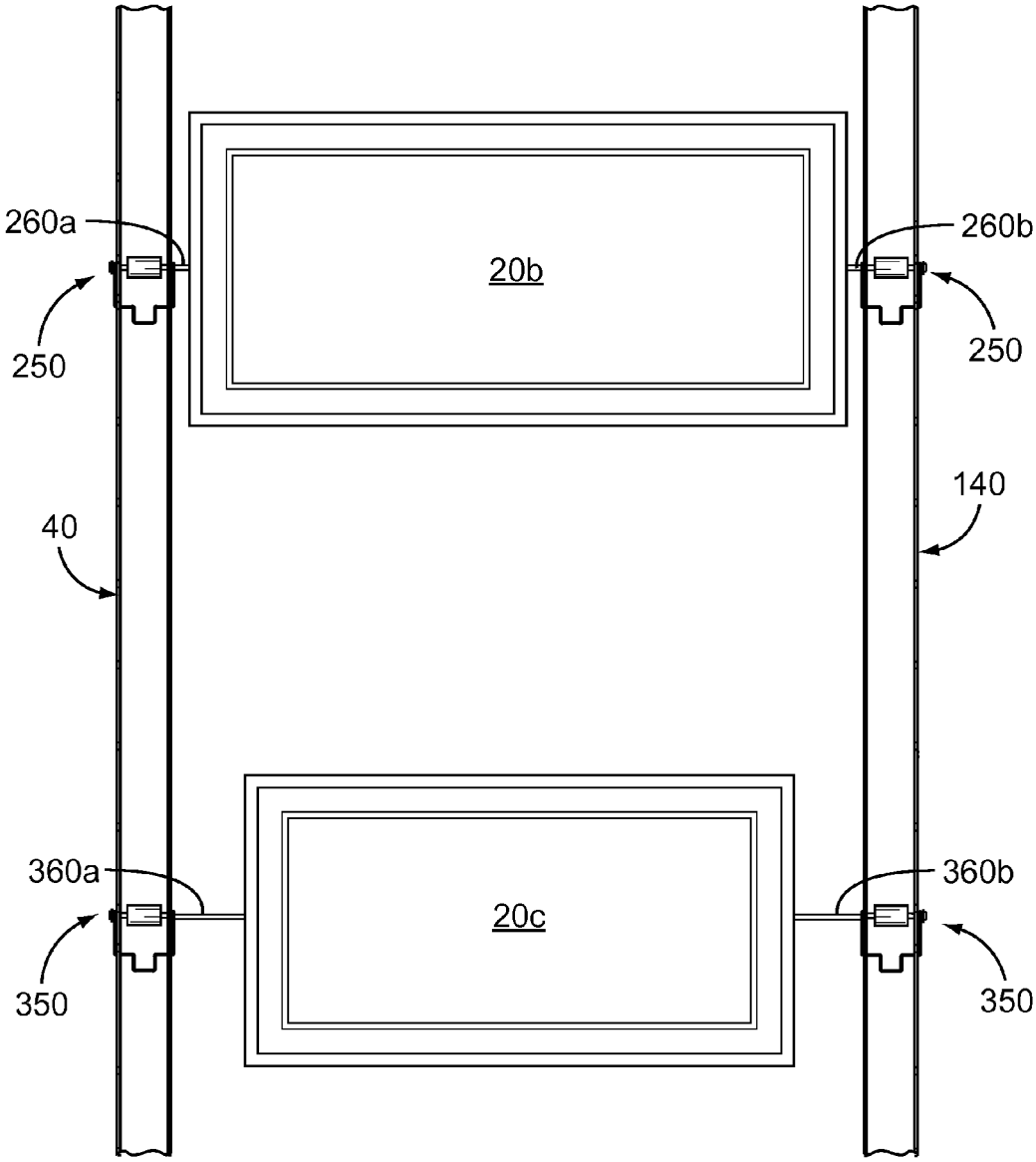
FIG. 1C is a partial front elevation view of a plurality of door panels on a first embodiment of a fixture.

The fixture 10 permits a user to work on either side of the door panels without removal of the panel therefrom. This aspect of the fixture 10 saves time in preparing, painting and finishing the plurality of door panels. In addition, floor space utilization is minimized because a plurality of door panels may be placed on fixture 10 at a time, side by side, and one above the other for painting, finishing, and drying. Further, in an embodiment, the fixture 10 allows a user to work on different sized door panels, regardless of their position on the fixture 10. For example, as shown in FIG. 1C, even different width door panels may be held between adjacent vertical supports 40 and 140 by using larger pins. At mounting station 250, the pin pairs 260*a* and 260*b* hold a first sized door panel 20*b*. At mounting station 350, longer pin pairs 360*a* and 360*b* are used to hold door panel 20*c*, which is narrower than door panel 20*b*.

While one fixture 10 is shown in the figures, one or more fixtures may be used to prepare, paint and finish as many door panels as needed. In an embodiment, multiple fixtures may be secured together.

The upper and lower horizontal supports 30, 32 and side supports 15, 17 are illustrated as being permanently welded. They could also be removably connected to each other by any number of connecting devices, e.g., screws, bolts, brackets, etc. Accordingly, in one embodiment, the fixture 10 may be easily collapsed by removing the upper and horizontal support bars 30 and 32 and vertical support bars 40 and 101, and storing the components for later use.

Referring again to FIGS. 1A, 1B and 3, the vertical supports 40 and 140 are slidably connected along upper and lower horizontal support bars 30 and 32. In the embodiment shown, upper and lower supports 30, 32 are U-shaped channels. Clamps 200*a* and 210*a* are used to removably and slidably secure the vertical support 40 to the upper support 30, while clamps 200*b* and 210*b* engage the lower support 32. The vertical supports 40 and 140 may slide along the upper horizontal supports 30 and 32 to preselected positions, thereby adjusting the spacing therebetween to accommodate the size of the door panel that is being worked on. As earlier suggested, the fixture 10 may have more than two vertical supports as needed. In an embodiment, the fixture 10 may be enlarged to accommodate more than two or three vertical supports as the need may arise. The vertical supports may be rigid, to extend between, and be slidably connected to the upper and lower horizontal supports 30 and 32.

Figure 3:
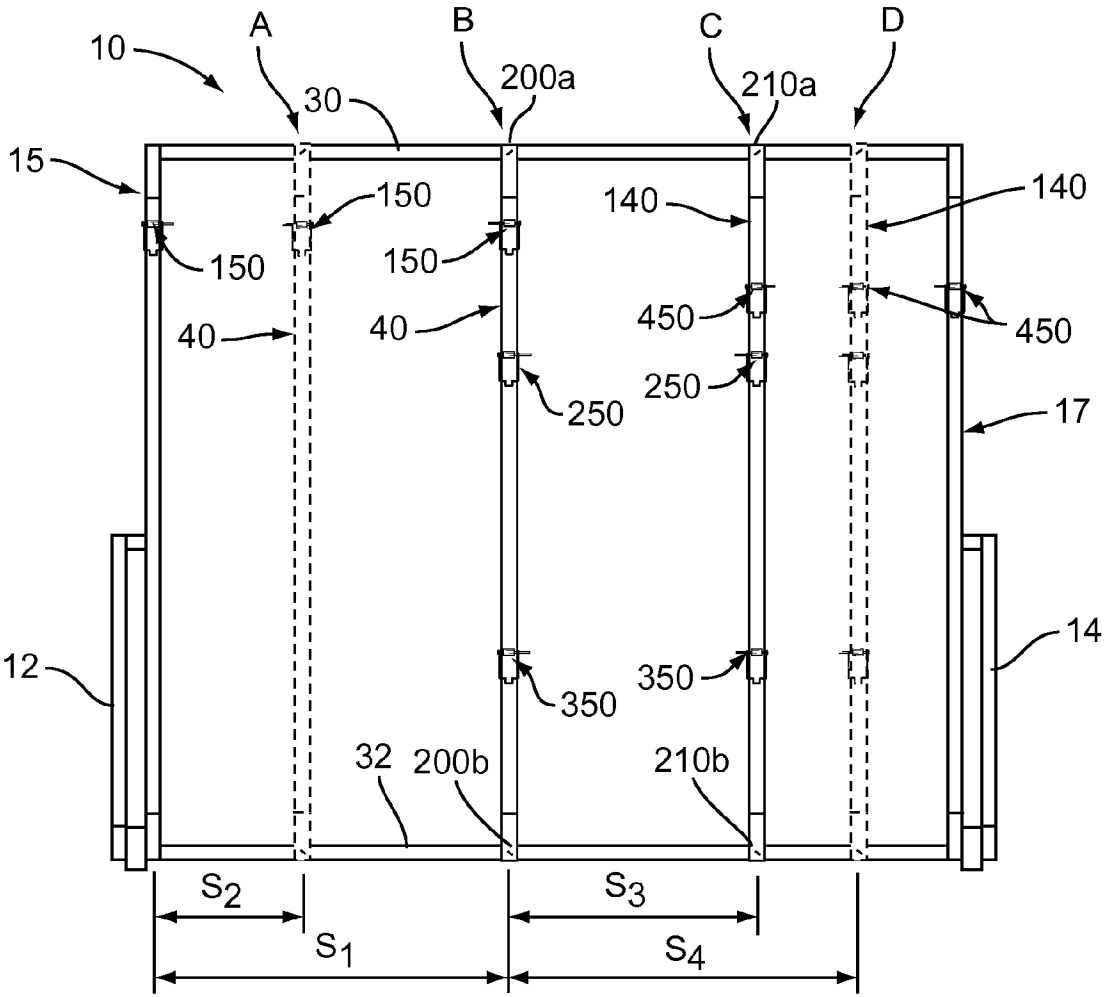
FIG. 3 is a front elevation view of a first embodiment of the fixture showing slidable vertical supports.

FIG. 3 illustrates how the vertical supports 40 and 140 may slide along the upper and horizontal supports 30 and 32 to adjust the spacing between adjacent vertical supports for processing wider or narrower panels. For example, the fixture 10 may have a first spacing, $S_1$, between the side 15 and the vertical support 40 in its first selected position B. The first spacing, $S_1$, is sized to a particular range of length or width of a door panel. The vertical support 40 may be moved along the horizontal supports closer to the side support 15 to its second selected position A, thereby creating a second spacing, $S_2$. In another embodiment, the vertical support bar 40 may stay in its original position B, relative to the vertical support bar 140, to have a third spacing, $S_3$, that holds a particular size range of door panels. The vertical support bar 140 may also slide along the horizontal supports 30 and 32 from a first selected position C to a second position D, thereby creating a second spacing, $S_4$.

Figures 4A, 4B, 4C:
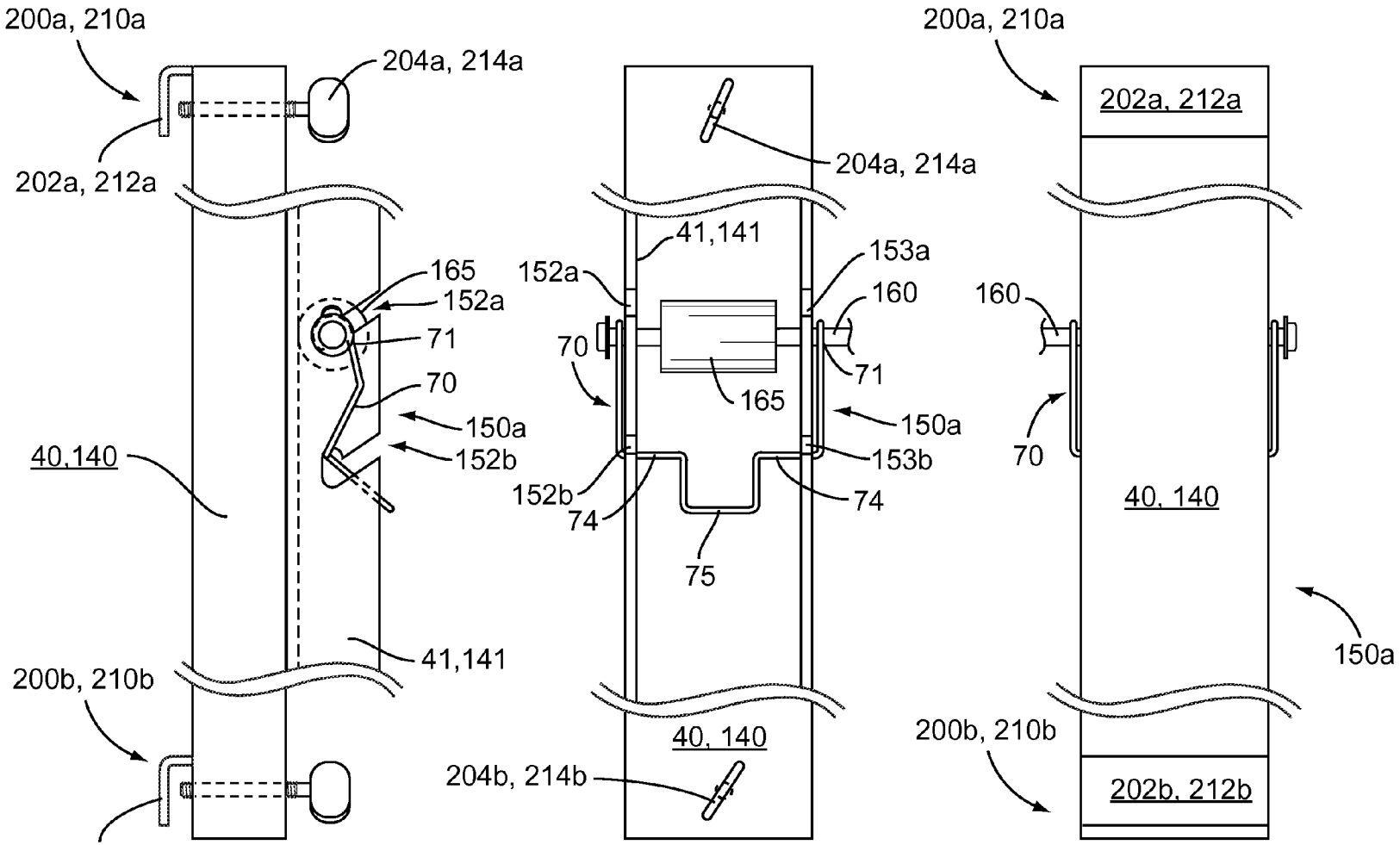
FIGS. 4A, 4B and 4C are side, front and back elevation views of a vertical support showing the attaching stations of a first embodiment, respectively.

FIGS. 4A, 4B, and 4C show an exemplary embodiment of a vertical support 40 or 140 with clamp pairs 200, 210 and an exemplary mounting station 150. As described above, the clamp pairs 200, 210 have an upper clamp 200*a*, 210*a* and lower clamp 200*b*, 210*b*. The clamps 200*a* and 200*b* are used to removably secure vertical supports at selected locations on the upper and lower horizontal support bars 30 and 32 to form the spacings described above. The clamps include a tab or flange 202, 212 extending from the vertical support 40, 140 that forms a slot which receives the horizontal support 30 or 32. The clamps include a screw 204, 214, that when tightened against flange 202, 212, removably secure the vertical support 40, 140 to a particular location on the adjacent leg of the upper and lower horizontal U-shaped supports 30 and 32. In other embodiments, however, a variety of mechanisms may be used to secure the vertical support bars to the upper horizontal supports 30 and 32. For example, other types of screws, bolts, pins, biased springs, clips, or other fasteners and mechanical devices may be used to secure the vertical supports at a particular location on the horizontal supports to fix the spacings $S_1$, $S_2$, $S_3$, as needed.

As discussed above, the vertical supports 40, 140 (and 15 and 17) have a plurality of mounting stations. "Mounting stations" as used herein, refers to devices or arrangements on the supports that support door panels at desired locations therebetween. The mounting stations may include slots, brackets, or other devices, used with pin pairs to engage a door panel. For example, a mounting station may include the bracket and pin shown in FIG. 8. Preferably, however, the mounting station includes a pair of slots 152*a*, 153*a* on the channels/supports and pin pairs 160 held therein as shown in FIGS. 4A and 4B. Each embodiment will be discussed below.

Referring again to FIG. 1B, the vertical supports include a plurality of mounting stations 150, 250, 350, and 450, that may be adjusted to any slot (not numbered in FIG. 1B) on the vertical supports and used with additional pin pairs to maximize the number of panels being treated simultaneously.

Figure 2:
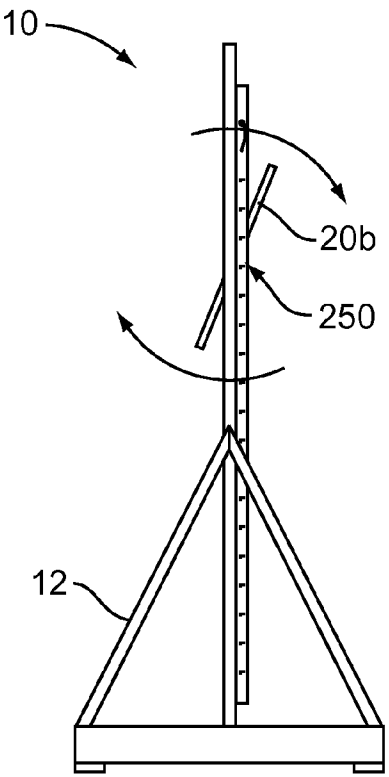
FIG. 2 is a side elevation view of a first embodiment of the fixture showing a door panel thereon.

Referring to FIGS. 1C and 2, mounting stations 250 and 350 are shown with pin pairs 260 and 360, respectively, on the vertical supports 40 and 140. At mounting station 250, for example, a pair of pins 260*a* and 260*b* holds a panel 20*b* therebetween, while also allowing the door panel to pivot so that a user can paint or finish one side of the panel while the other side of the panel is drying. For example, referring to FIG. 2, the fixture 10 is shown having a door panel 20*b* mounted between pin pairs 260 (pin pairs not shown) at mounting station 260. The panel 20*b* may rotate 360° about an axis between the pin pairs 260.

As shown in FIGS. 4A and 4B, each mounting station 150 includes slot pairs 152 and 153 in the legs of channels 41, 141; pin pairs 160 resting in slots 152 and 153; and a sleeve 165 and restraining member or clip 70. The channel 41, 141 has a "U-shaped" profile with legs that extend perpendicularly out from the support. One of the legs has a plurality of slots 152*a*, 152*b*, 152*c*, . . . 152*n* along the length of the channel, while the other leg includes corresponding slots 153*a*, 153*b*, 153*c*, . . . 153*n* that align with the corresponding slot in the one leg. The slot pairs 152, 153 extend from the free edge of each leg downwardly toward the back surface of the channel 41, 141 then upwardly. The corresponding slot pairs 152 and 153, have substantially the same elevation on channel 41,141. The slots pairs 152, 153 receive the pin 160 as shown in FIG. 4B. As described above, the channels 16, 41, 141, and 18, may be secured along the length of the supports 15, 40, 140, and 17, respectively. In an embodiment, the channels and supports are integrally formed as a unitary structure. In other embodiments, the channels and supports may be separate components secured together. Further, any type of support/channel configured to support a pin may be used.

A pin 160 extends from the mounting station 150*a* toward an opposing pin 160*b* (not shown in FIGS. 4A-4C, but see FIG. 1C) on an adjacent vertical support, 140 for example. Opposed pins 160 extend into the narrow edges of the door panel 20 just sufficiently to normally hold the panel in position therebetween but allow pivotal movement by the operator when desired.

Referring again to FIGS. 4A and 4B, a retaining sleeve 165 is positioned on each pin 160 and cooperates with a clip 70 to limit swaying motion of a door panel. The retaining sleeve 165 may be a tubular rubber-like material with an opening extending therethrough for receiving a pin. In other embodiments, the sleeve may be a polymeric material, and may have an anti-slip coating thereon. The width of sleeve 165 is typically less than the distance between opposing legs of the channel 41, 141. As shown in FIG. 4A, the sleeve 65, while on the pin 160, is in contact with the rear surface of the channel 41,141.

The clip 70 includes at one end a pair of hooks 71 engaging the pin 160 just outside the legs of the channel 41, 141 proximate the slots 152*a* and 153*a*. At the other end of the clip 70 are locking legs 74 that fit into the lower, adjacent slot 152*b* and 153*b*. A tab 75 may be used to pull the locking legs 74 out of the slots 152*b* and 153*b*. Accordingly, the tab 75 may also be used to push the locking legs 74 into the slot 152*b*. The clip 70 holds the sleeve against the base of the channel 41, 141, and the friction of the sleeve 165 against the channel 41, 141 keeps the door panel steady during finishing and painting.

Figure 5A:
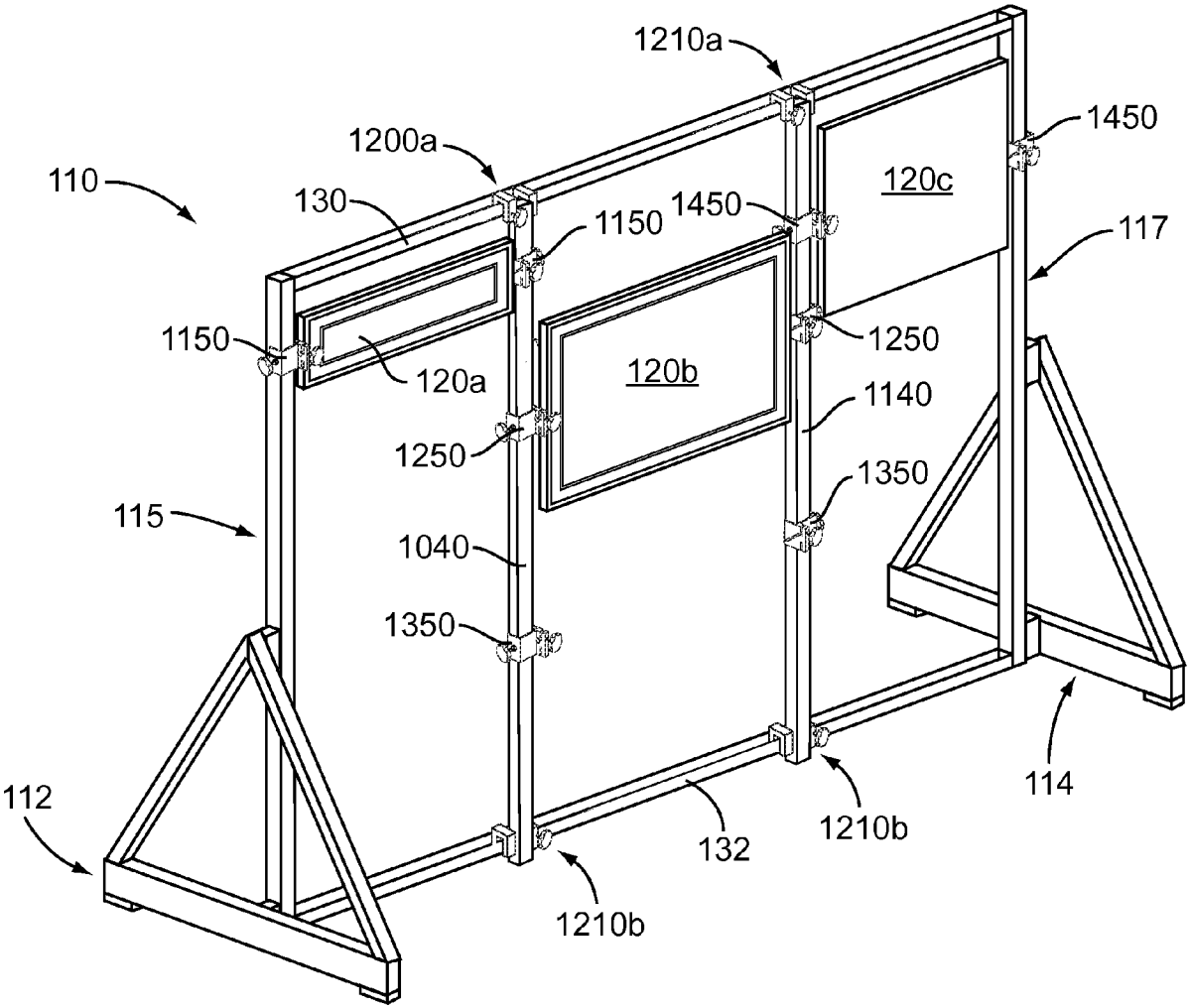
FIGS. 5A and 5B are top perspective views of a second embodiment of a fixture with and without a plurality of door panels arranged thereon, respectively.
Figure 5B:
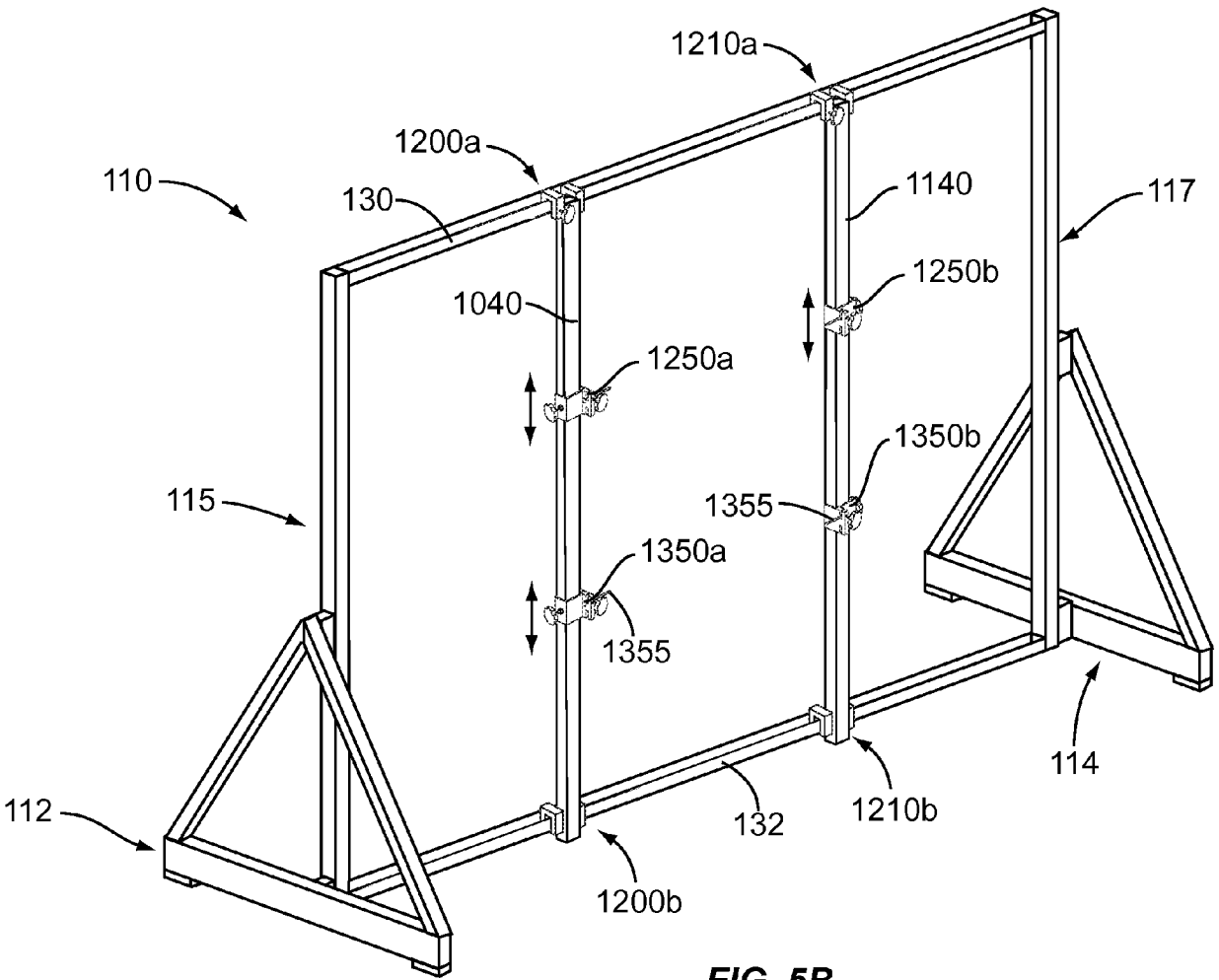

Referring to FIGS. 5A and 5B, another embodiment of a fixture 110 is shown holding a plurality of door panels 120*a*, 120*b*, and 120*c* for preparation, painting and finishing thereof. The fixture 110, side supports 115 and 117, upper and lower horizontal supports 130 and 132, and a plurality of vertical supports 1040 and 1140 attached to the horizontal supports 130 and 132. As with the other embodiment described above, vertical supports 1040 and 1140 are exemplary only, in that there can be more. Frame struts 112 and 114 provide stability to and support fixture 10. The panels 120*a*, 120*b*, and 120*c* are held in position by, and are pivotable between, bracket pairs 1150, 1250, and 1350 located on the vertical supports 1040 and 1141, and side supports 115 and 117. The number of bracket pairs can be numerous as multiple panels can be mounted between each adjacent pair of vertical supports.

As with the first embodiment, the second embodiment of the fixture 110 also permits a user to work on either side of the door panels without removal of the panel therefrom. This aspect of the fixture 110 saves time in preparing, painting and finishing the plurality of door panels. In addition, floor space utilization is minimized because a plurality of door panels may be placed on fixture 110 at a time side by side and one above the other for painting, finishing, and drying.

As described above, while one fixture 110 is shown in the figures, one or more fixtures may be used to prepare, paint and finish as many door panels as needed. Multiple fixtures may be secured together. Also the fixture 110 may be easily collapsed by removing the upper and horizontal support bars 130 and 132 and vertical support bars 1040, 1140 and storing the components for later use. It should be noted that the upper and lower horizontal supports 130, 132 and side supports 115, 117 are illustrated as being permanently welded. They could also be removably connected to each other by any number of connecting devices (screws, bolts, brackets, etc.) to provide for the above described collapsing for storage.

Figure 7:
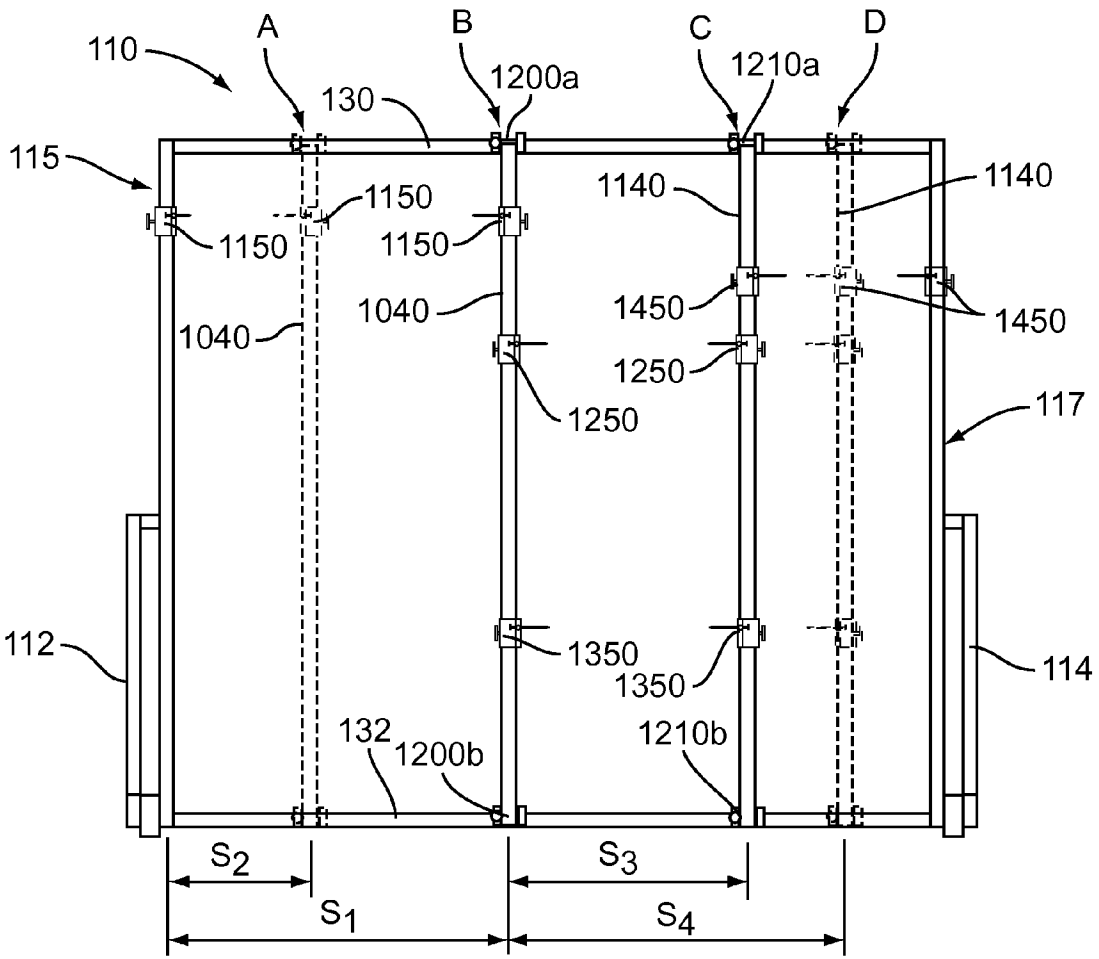
FIG. 7 is a front elevation view of a second embodiment of a fixture showing slidable vertical supports.

Referring again to FIGS. 5A, 5B and 7, the vertical supports 1040 and 1140 are slidably connected to the upper and lower horizontal support bars 130 and 132 (again U-shaped channels) with clamp pairs, 1200 and 1210 respectively. In the embodiment shown, clamps 1200*a* and 1210*a* are removably and slidably secured to the upper support 130, while clamps 1200*b* and 1210*b* engage the lower support 132. The vertical supports 1040 and 1140 may slide along the upper horizontal supports 130 and 132 to preselected positions, thereby adjusting the spacing therebetween to accommodate the size of the door panel that is being worked on. As earlier suggested, the fixture 110 may have more than two vertical supports as needed. In the embodiment, the fixture 110 may be enlarged to accommodate more than two or three vertical supports as the need may arise. In addition, the vertical supports 1040 and 1140 in FIGS. 9, 10, 11 and 12, have a "U" shaped profile. In other embodiments, however, the supports may have any shape or profile that includes, but is not limited to, "L" shaped, "I" shaped (e.g., an I-beam), circular, square, rectangular, flat, or any other shape. The vertical supports may be rigid to extend between, and be slidably connected to, the upper and lower horizontal supports 130 and 132.

Similar to embodiments described above, FIG. 7 illustrates how the vertical supports 1040 and 1140 may slide along the upper and horizontal supports 130 and 132 to adjust the spacing between adjacent vertical support. For example, the fixture 110 may have a first spacing, $S_1$, between the frame side 16 and the vertical support 1040 in first selected position B. The first spacing, $S_1$, is sized to a particular length or width of a door panel. The vertical support 1040 may move along the horizontal supports closer to side support 115 to second selected position A, thereby creating a second spacing, $S_2$. In another embodiment, the vertical support bar 1040 may stay in its original position (1040B), relative to the vertical support bar 1140, to have a third spacing, $S_3$, that holds a particular sized door panel. The vertical support bar 1140 may also slide along the horizontal supports 30 and 32 from a first selected position C to a second position D, thereby creating a second spacing, $S_4$. Similarly bracket pairs 1150, 1250, 1350, and 1450 may be adjusted vertically and used with additional bracket pairs to maximize the number of panels being treated simultaneously.

FIGS. 9, 10, 11 and 12, show an exemplary embodiment of a vertical support 1040 and 1140 with the clamp pairs 1200 and 1210, respectively. The clamps include a housing 1172 forming clamp slots 1174 that are configured to receive the horizontal supports 130 or 132. For example, an upper clamp slot 1174*a* receives the upper horizontal support 130, while the lower clamp slot 1174*b* receives the lower horizontal support 132.

Referring again to FIGS. 9, 10, 11 and 12, the clamps 1170*a* and 1170*b* are used to removably secure vertical supports 1040, 1140 at a selected location on the upper and lower horizontal support bars 130 and 132. In an embodiment, clamps use knobs and bolt combinations to secure the vertical supports 1040, 1042 on the upper and lower horizontal supports 130 and 132. However, a variety of mechanisms may be used to secure the vertical support bars to the upper horizontal supports 130 and 132. For example, screws, bolts, pins, biased springs, clips, or other fasteners and mechanical devices may be used to secure the vertical supports at a particular location on the horizontal supports to fix the spacings $S_1$, $S_2$, $S_3$, as needed.

Figure 6:
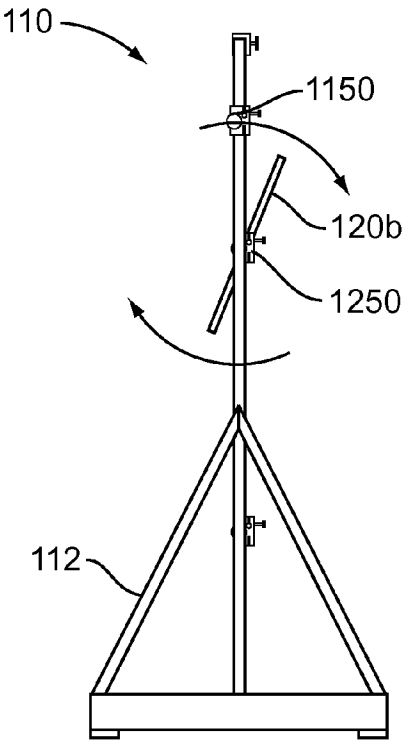
FIG. 6 is a side elevation view of a second embodiment of a fixture showing door panels thereon.

As shown in FIGS. 5A and 5B, multiple bracket pairs 1150, 1250, 1350, and 1450, are slidably connected to sides 115 and 117 and vertical supports 1040 and 1140. A bracket pair, e.g., 1250, is removably and slidably placed on vertical supports 1040 and 1140 and holds a panel 120*b* therebetween, while also allowing the pivoting thereof so that a user can paint or finish one side of the panel while the other side of the panel is drying. For example, referring to FIG. 6, the fixture 110 is shown having a door panel 120*b* mounted on a bracket pair 1250 (the other of the bracket pair not shown). The panel 120*b* may rotate 360° about an axis between the brackets pairs (of the pair 1350).

Figure 8:
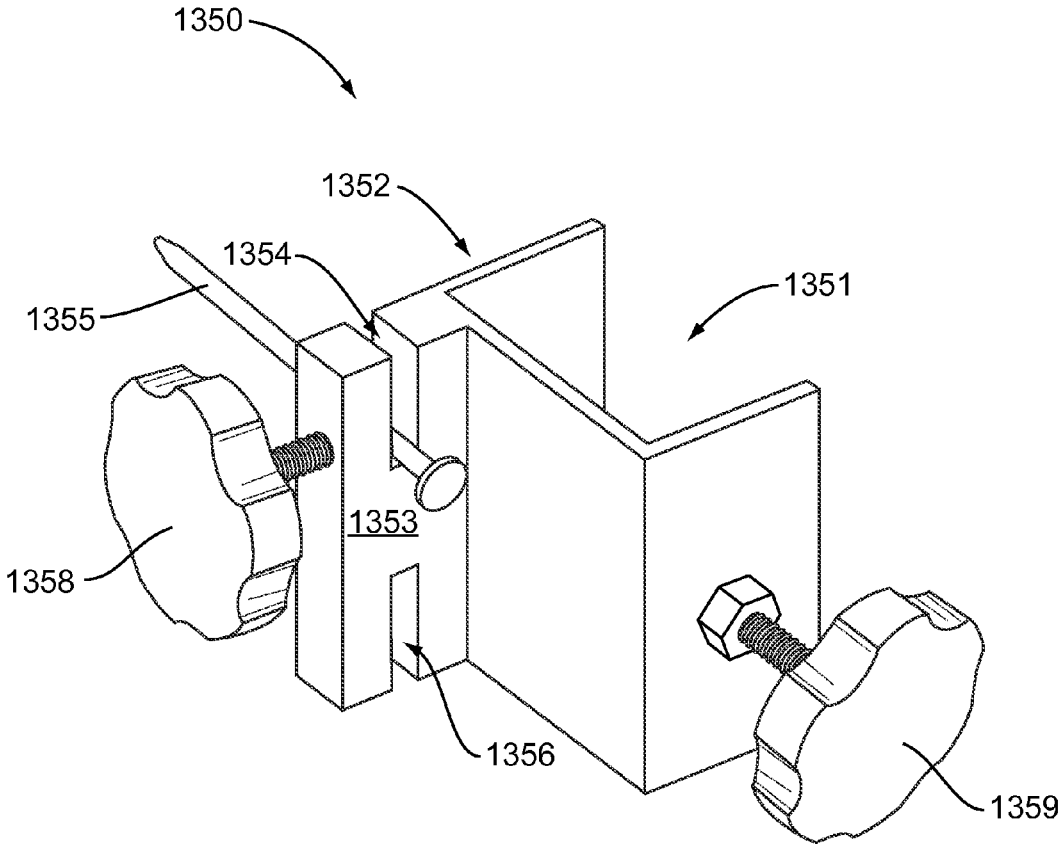
FIG. 8 is a top perspective view of a bracket used to hold and pivot the door panels on a second embodiment of a fixture.
Figure 9:
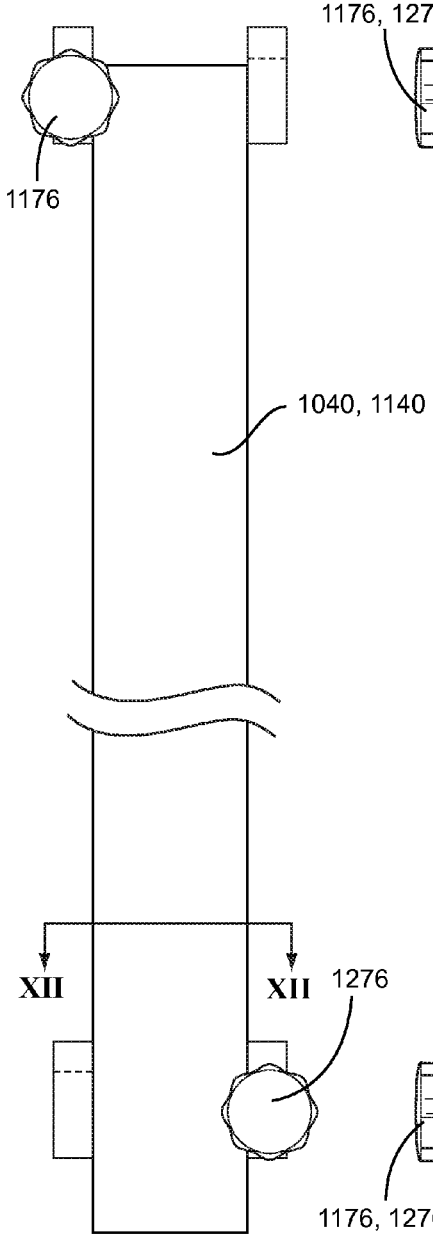
FIGS. 9 and 10 are front and side elevation views of a vertical support bar showing a pair of clamps thereon, respectively.
Figure 10:
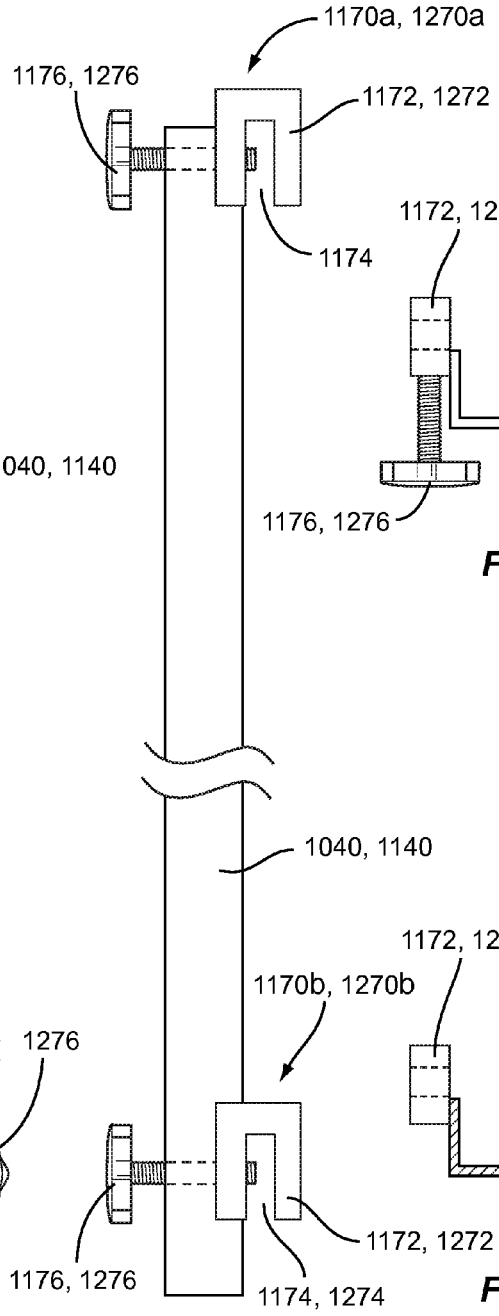
Figure 11:
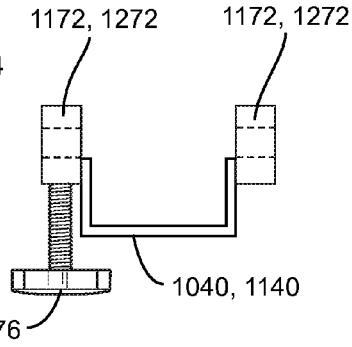
FIG. 11 is a top plan view of a vertical support and clamp used to attach the vertical support to the horizontal support of a second embodiment.
Figure 12:
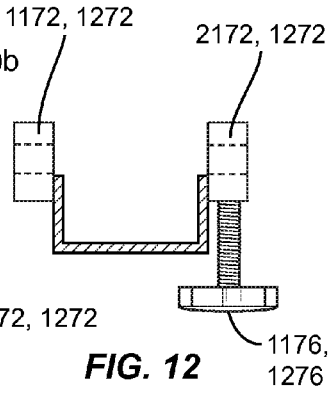
FIG. 12 is a cross-section of a vertical support bar of a second embodiment taken along line 12-12 of FIG. 11.

As shown in FIG. 8, bracket 1350 has a projection 1353 that extends from the housing 1352 and includes two slots in opposing directions, for example, an upper slot 1354 and a lower slot 1356. These slots (1354 and 1356) receive or hold the engagement pin 1355, depending on the orientation of the bracket 1350 on the vertical support. The engagement pin 1355 extends from the bracket 1350 and toward the opposing engagement pin of the other bracket in the pair 1350. Opposed engagement pins 1355 extend into the narrow edges of the door panel 1120 just sufficiently to normally hold the panel in position therebetween but allow pivotal movement by the operator when desired.

In an exemplary embodiment, each bracket pair may be used on either side of the door panel, or any of the vertical supports 1040, 1140 and frame sides 115 and 117 as needed, depending on the orientation of the bracket discussed above. For example, as shown in FIG. 5B, one of brackets in the pair 1350 is positioned on the vertical support 1040 so that the engagement pin 1355 extends in one direction (shown extending toward the side support 116). As needed, the bracket 1350 may be removed from the support 1040, and rotated 180° so that the engagement pin 1355 would point in the opposite direction toward side support 117. In this case, the slot 1354 in FIG. 8 would be in the lower position and slot 1356 would be in the upper position, with the engagement pin 1355 placed in slot 1356. This aspect of the fixture 110 provides the contractor or user of the fixture 110 flexibility to arrange panels thereon.

FIG. 8 also shows that a knob 1358 attached to a screw may be used to secure the engagement pin within the slot 1354 (or 1356). The bracket pin 1355 may be secured in a selected position along the vertical supports 115, 117, 1040, and 1140. In the embodiment show in FIG. 8, a second knob 1359 may be used to secure the housing 1352 at a selected location on the vertical support. In other embodiments, various other types of fasteners or mechanisms to fix a bracket or housing at a particular location on the vertical support bar 1040, 1140, 1240 may be used. Alternate embodiments of the engagement pin 1355 may form an integral part of the projection 1353 in housing 1352. It should be noted that this bracket arrangement allows for universal adjustment along the vertical support.

As described above, another aspect of the invention is a method of economically holding, finishing and painting a plurality of door panels. A user may erect or install a fixture that is capable of removably holding a plurality of door panels in such a way that the panels are pivotal so that a user can finish and paint either surface of the door panel without removing the door panels from the fixture. More than one fixture may be used to paint and finish even a greater plurality of door panels. After installation at the desired work space, a plurality of door panels are arranged on the fixture. A user may then paint and/or finish one side of the panels. The panel(s) would then be pivoted 180° and the other side painted or finished. After each treatment is allowed to dry, the process can be repeated until the desired number of coats have been applied.

The fixtures as disclosed herein may be formed of any particular metal alloy, such as stainless steel or aluminum. In other embodiments, the fixture may be formed from suitable rigid polymeric materials. Further, portions of the fixtures may be metal or aluminum, while other parts may be polymeric.

Although the present invention has been described with exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

What is claimed is:

1. A fixture for supporting a plurality of panels during painting and finishing thereof, each panel having opposed side surfaces interconnected by a relatively narrow edge, the fixture comprising;

a. upper and lower horizontal support bars;

b. a plurality of spaced vertical support bars extending between and slidably attached to the upper and lower horizontal support bars to provide for lateral adjustment of the spacing therebetween, each bar being provided with a plurality of panel mounting stations;

c. a plurality of pairs of pins, each pin having a shaft so configured as to be received and supported by the panel mounting station of the adjacent vertical support bar;

d. whereby each pair of pins removably engage the opposite edges of a panel and support one of the panels in the fixture for pivotal movement, painting and finishing of the panel.

2. The fixture of claim 1 wherein each vertical bar comprises a U-shaped channel, each panel mounting station comprises a slot in each leg of the channel extending from the free edge, the corresponding pin being received in and supported by the slot in each leg of the channel.

3. The fixture of claim 1 further comprising a means for restraining the pairs of pins and the panel between the pairs of pins on the fixture.

4. The fixture of claim 2, further comprising a sleeve around the pin and between the legs of the channel; and a restraining member on one end having a pair of hooks that engage the pin supported in the slots of the channel and on the other end a locking leg for engaging an adjacent slot on the channel, whereby the restraining member and the locking leg press the sleeve against the channel to limit rotational movement of the pin and the panel therebetween.

5. The fixture of claim 1, wherein each vertical support bar further comprises a pair of clamps on opposing ends thereof, the clamps having a slot for receiving one of the horizontal support bars and allowing for adjustment of the vertical support bars laterally along the horizontal supports, the clamps further capable of securing the vertical supports in position along the horizontal support bars.

6. The fixture of claim 1, wherein the plurality of vertical support bars have a means for slidably engaging and being secured to the upper and lower horizontal support bars.

7. The fixture of claim 1 wherein each mounting station includes a bracket being adjustable vertically along one of the vertical support bars and, the bracket having an engagement pin extending inwardly from the bracket toward an adjacent vertical support bar and adjustably extendable into engagement with the edge of the panel to hold the panel for pivotal movement, finishing, and painting of the panel between the engagement pin extending inwardly from a corresponding bracket on the adjacent vertical support bar.

8. The fixture of claim 7, wherein the bracket and corresponding bracket have a means for engaging and holding the pins for controlling pivotal movement of the panel during painting and finishing.

9. The fixture of claim 7, wherein each vertical support bar further comprises a pair of clamps on opposing ends thereof, the clamps having a slot for receiving one of the horizontal support bars and allowing for adjustment of the vertical support bars laterally along the horizontal supports, the clamps further capable of securing the vertical supports in position along the horizontal support bars.

10. The fixture of claim 7, wherein the plurality of vertical support bars have a means for slidably engaging and being secured to the upper and lower horizontal support bars.

11. The fixture of claim 7, wherein each of the brackets comprises;

a housing forming a slot for receiving the vertical support bar, and a projection extending from the housing and having an upper and lower slot therein, the upper and lower slot for receiving the pin that extends in adjustable engagement with the panel.

12. The fixture of claim 11, wherein the housing comprises a means for securing the bracket to a selected location on the vertical support bar.

* * * * *